US006334329B1

(12) United States Patent
Weller

(10) Patent No.: US 6,334,329 B1
(45) Date of Patent: Jan. 1, 2002

(54) WINE BOX COOLING DEVICE

(76) Inventor: Susan G. Weller, 8918 Menkar Rd., San Diego, CA (US) 92126

( * ) Notice: Subject to any disclaimer, the term of this patent is extended or adjusted under 35 U.S.C. 154(b) by 3 days.

(21) Appl. No.: 09/591,059

(22) Filed: Jun. 9, 2000

(51) Int. Cl.[7] ..... F25D 3/08

(52) U.S. Cl. ..... 62/371; 62/457.8; 62/457.4; 62/459; 62/396

(58) Field of Search ..... 62/457.8, 457.4, 62/459, 396, 371

(56) References Cited

U.S. PATENT DOCUMENTS 583,652 A 6/1897 Mulligan
592,781 A * 11/1897 Hertwig ..... 62/457
3,365,911 A * 1/1968 Stoner et al. ..... 62/457.8
3,998,072 A 12/1976 Shaw
4,164,851 A * 8/1979 Bryant ..... 62/381
4,255,944 A 3/1981 Gardner et al.
4,531,381 A 7/1985 Toro et al.
4,543,801 A * 10/1985 Damiens ..... 62/457
D282,138 S 1/1986 Gullikson
4,809,522 A * 3/1989 de Nevers et al. ..... 62/457
4,961,324 A * 10/1990 Allan ..... 62/400
D340,167 S 10/1993 Kahl
5,444,992 A * 8/1995 Bell ..... 62/372
5,966,964 A * 10/1999 Pattee ..... 62/457.4

* cited by examiner

*Primary Examiner*—William Doerrler
*Assistant Examiner*—Mark Shulman

(57) ABSTRACT

A wine box cooling device for cooling and keeping cool a wine box. The wine box cooling device includes a housing. The housing has a base portion and cover portion. The base portion comprises a bottom wall. The bottom wall has a peripheral edge. A peripheral wall is integrally coupled to and extends upwardly from the peripheral edge such that a front wall, a back wall and a pair of side walls are defined. The front wall has a top edge. The top edge of the front wall a depression therein. A cover portion comprises a top wall. The top wall has a peripheral edge. A perimeter wall is integrally coupled to and extends downwardly from the peripheral edge of the top wall such that a proximal wall, a distal wall and two side walls are defined. The cover portion has a size adapted to cover the base portion. An ice block is positioned within the base portion and a wine box is positioned on the ice block such that a pour spout of the wine box extends over the depression.

10 Claims, 3 Drawing Sheets

WINE BOX COOLING DEVICE

BACKGROUND OF THE INVENTION

1. Field of the Invention

The present invention relates to wine cooling devices and more particularly pertains to a new wine box cooling device for cooling and keeping cool a wine box.

2. Description of the Prior Art

The use of wine cooling devices is known in the prior art. More specifically, wine cooling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Des. Pat. No. 282,138; U.S. Pat. No. 3,998,072; U.S. Pat. No. 4,255,944; U.S. Des. Pat. No. 583,652; U.S. Pat. No. 4,531,381; and U.S. Des. Pat. No. 340,167.

While these devices fulfill their respective, particular objectives and requirements, the aforementioned patents do not disclose a new wine box cooling device. The inventive device includes a housing. The housing has a base portion and cover portion. The base portion comprises a bottom wall. The bottom wall has a peripheral edge. A peripheral wall is integrally coupled to and extends upwardly from the peripheral edge such that a front wall, a back wall and a pair of side walls are defined. The front wall has a top edge. The top edge of the front wall a depression therein. A cover portion comprises a top wall. The top wall has a peripheral edge. A perimeter wall is integrally coupled to and extends downwardly from the peripheral edge of the top wall such that a proximal wall, a distal wall and two side walls are defined. The cover portion has a size adapted to cover the base portion. An ice block is positioned within the base portion and a wine box is positioned on the ice block such that a pour spout of the wine box extends over the depression.

In these respects, the wine box cooling device according to the present invention substantially departs from the conventional concepts and designs of the prior art, and in so doing provides an apparatus primarily developed for the purpose of cooling and keeping cool a wine box.

SUMMARY OF THE INVENTION

In view of the foregoing disadvantages inherent in the known types of wine cooling devices now present in the prior art, the present invention provides a new wine box cooling device construction wherein the same can be utilized for cooling and keeping cool a wine box.

The general purpose of the present invention, which will be described subsequently in greater detail, is to provide a new wine box cooling device apparatus and method which has many of the advantages of the wine cooling devices mentioned heretofore and many novel features that result in a new wine box cooling device which is not anticipated, rendered obvious, suggested, or even implied by any of the prior art wine cooling devices, either alone or in any combination thereof.

To attain this, the present invention generally comprises a housing. The housing has a base portion and cover portion. The base portion comprises a bottom wall. The bottom wall has a peripheral edge. A peripheral wall is integrally coupled to and extends upwardly from the peripheral edge such that a front wall, a back wall and a pair of side walls are defined.

The front wall has a top edge. The top edge of the front wall a depression therein. A cover portion comprises a top wall. The top wall has a peripheral edge. A perimeter wall is integrally coupled to and extends downwardly from the peripheral edge of the top wall such that a proximal wall, a distal wall and two side walls are defined. The cover portion has a size adapted to cover the base portion. An ice block is positioned within the base portion and a wine box is positioned on the ice block such that a pour spout of the wine box extends over the depression.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wine box cooling device apparatus and method which has many of the advantages of the wine cooling devices mentioned heretofore and many novel features that result in a new wine box cooling device which is not anticipated, rendered obvious, suggested, or even implied by any of the prior art wine cooling devices, either alone or in any combination thereof.

It is another object of the present invention to provide a new wine box cooling device which may be easily and efficiently manufactured and marketed.

It is a further object of the present invention to provide a new wine box cooling device which is of a durable and reliable construction.

An even further object of the present invention is to provide a new wine box cooling device which is susceptible of a low cost of manufacture with regard to both materials and labor, and which accordingly is then susceptible of low prices of sale to the consuming public, thereby making such wine box cooling device economically available to the buying public.

Still yet another object of the present invention is to provide a new wine box cooling device which provides in the apparatuses and methods of the prior art some of the advantages thereof, while simultaneously overcoming some of the disadvantages normally associated therewith.

Still another object of the present invention is to provide a new wine box cooling device for cooling and keeping cool a wine box.

Yet another object of the present invention is to provide a new wine box cooling device which includes a housing. The housing has a base portion and cover portion. The base portion comprises a bottom wall. The bottom wall has a peripheral edge. A peripheral wall is integrally coupled to and extends upwardly from the peripheral edge such that a front wall, a back wall and a pair of side walls are defined. The front wall has a top edge. The top edge of the front wall a depression therein. A cover portion comprises a top wall. The top wall has a peripheral edge. A perimeter wall is integrally coupled to and extends downwardly from the peripheral edge of the top wall such that a proximal wall, a distal wall and two side walls are defined. The cover portion has a size adapted to cover the base portion. An ice block is positioned within the base portion and a wine box is positioned on the ice block such that a pour spout of the wine box extends over the depression.

Still yet another object of the present invention is to provide a new wine box cooling device that is adapted for cooling conventional wine boxes which are often used at outdoor events and are subject to temperature variations.

Even still another object of the present invention is to provide a new wine box cooling device that has a carrying means for easy carrying of the device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
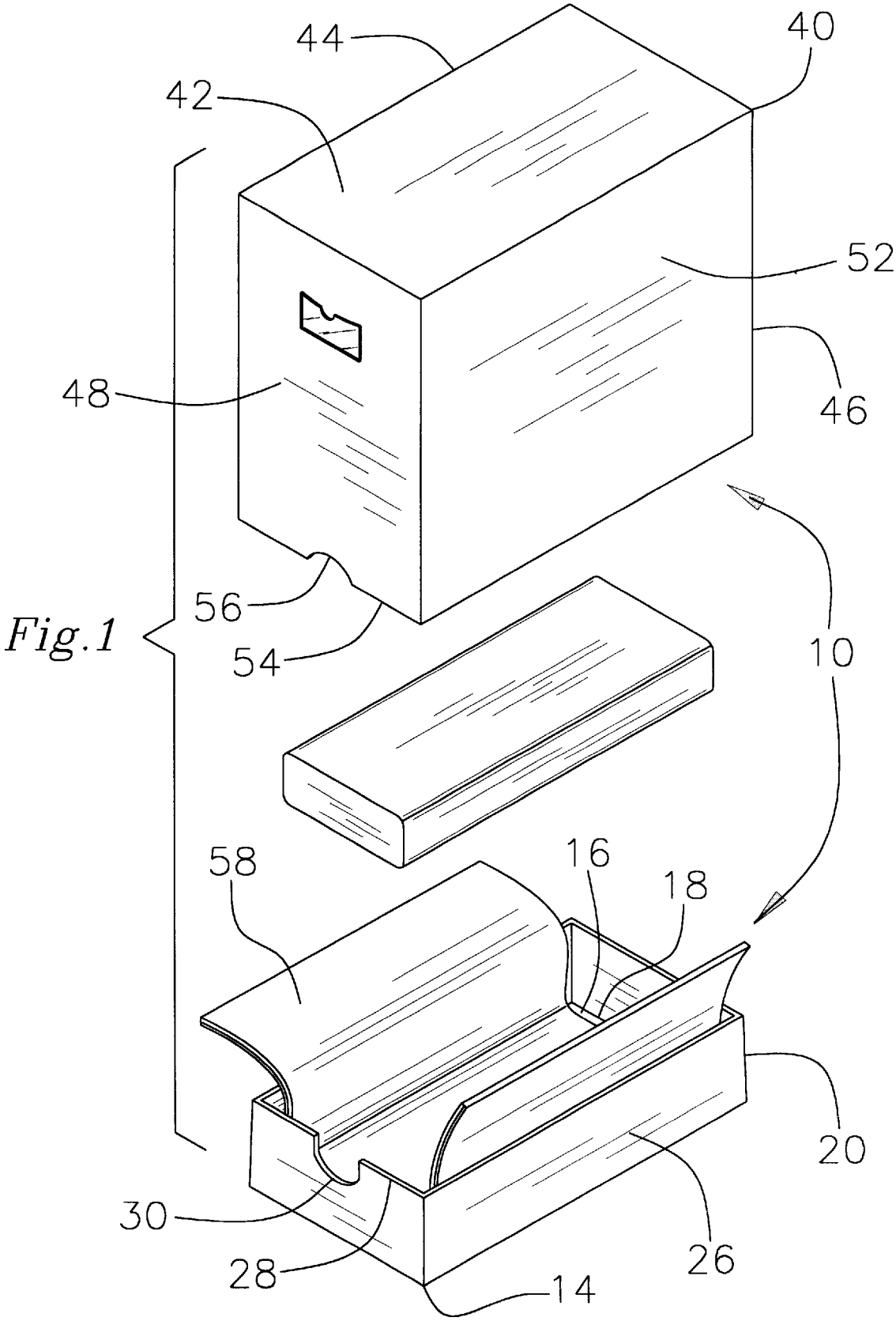
FIG. 1 is a schematic perspective view of a new wine box cooling device according to the present invention.

With reference now to the drawings, and in particular to FIGS. 1 through 5 thereof, a new wine box cooling device embodying the principles and concepts of the present invention and generally designated by the reference numeral 10 will be described.

As best illustrated in FIGS. 1 through 5, the wine box cooling device 10 generally comprises a housing 12. The housing 12 includes a base portion 14 and a cover portion 40. The base 14 and cover 40 portions each preferably comprises a plastic material.

The base portion 14 comprises a bottom wall 16. The bottom wall 16 has a peripheral edge 18. A peripheral wall 20 is integrally coupled to and extends upwardly from the peripheral edge 18 such that a front wall 22, a back wall 24 and a pair of side walls 26 are defined. The front wall 22 has a top edge 28. The top edge 28 of the front wall 22 a depression therein 30. The depression 30 is preferably positioned generally between and ideally equidistant from the side walls 26. The peripheral wall 20 preferably has a height between 2 and 4 inches.

Figure 2:
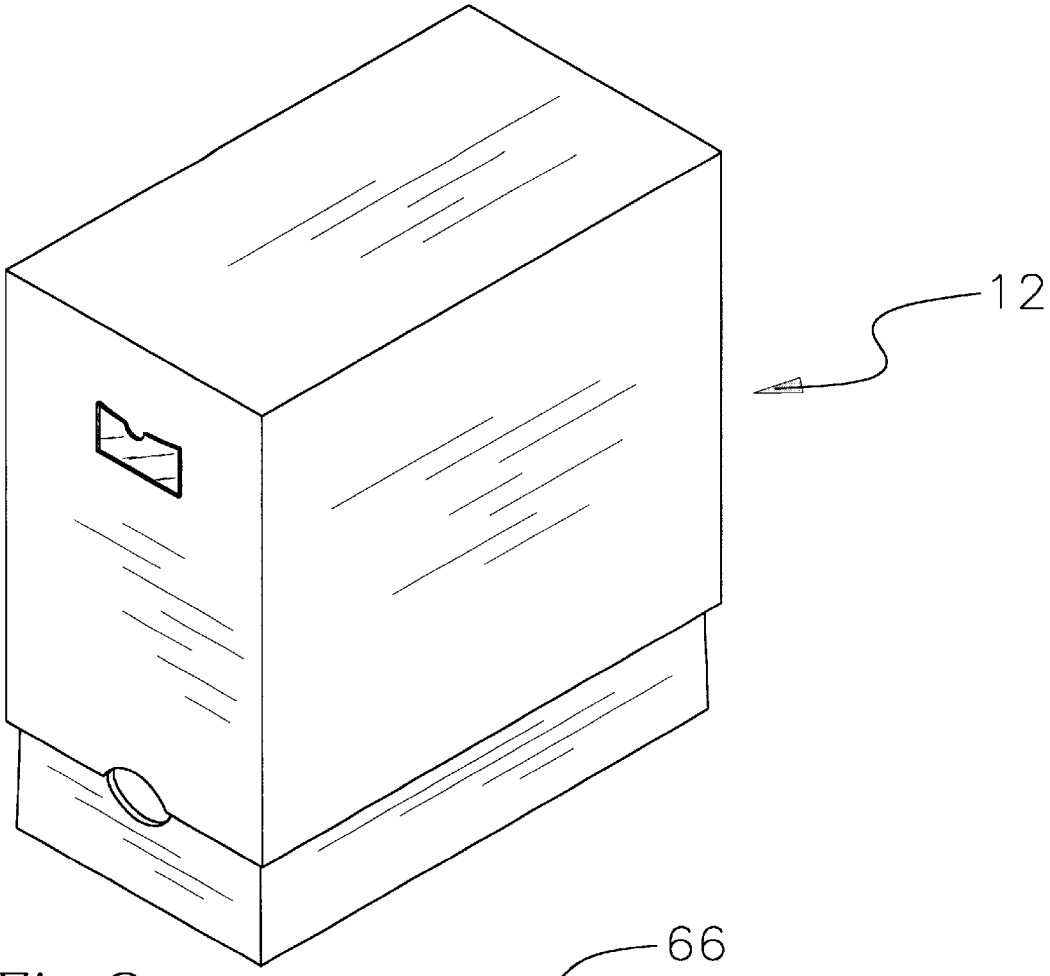
FIG. 2 is a schematic perspective view of the present invention in a closed position.
Figure 3:
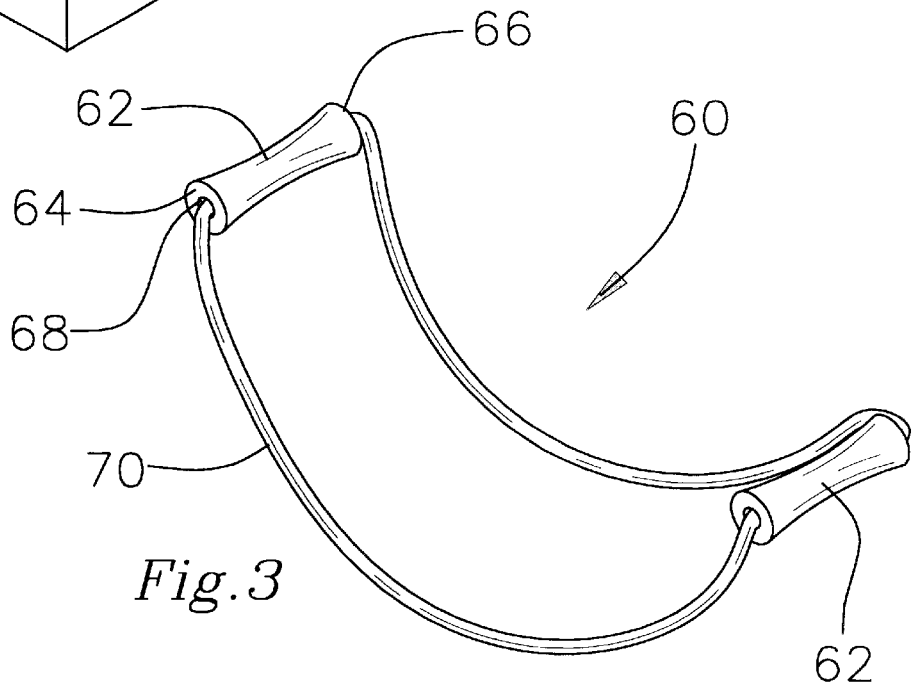
FIG. 3 is a schematic perspective view of the carrying means present invention.
Figure 4:
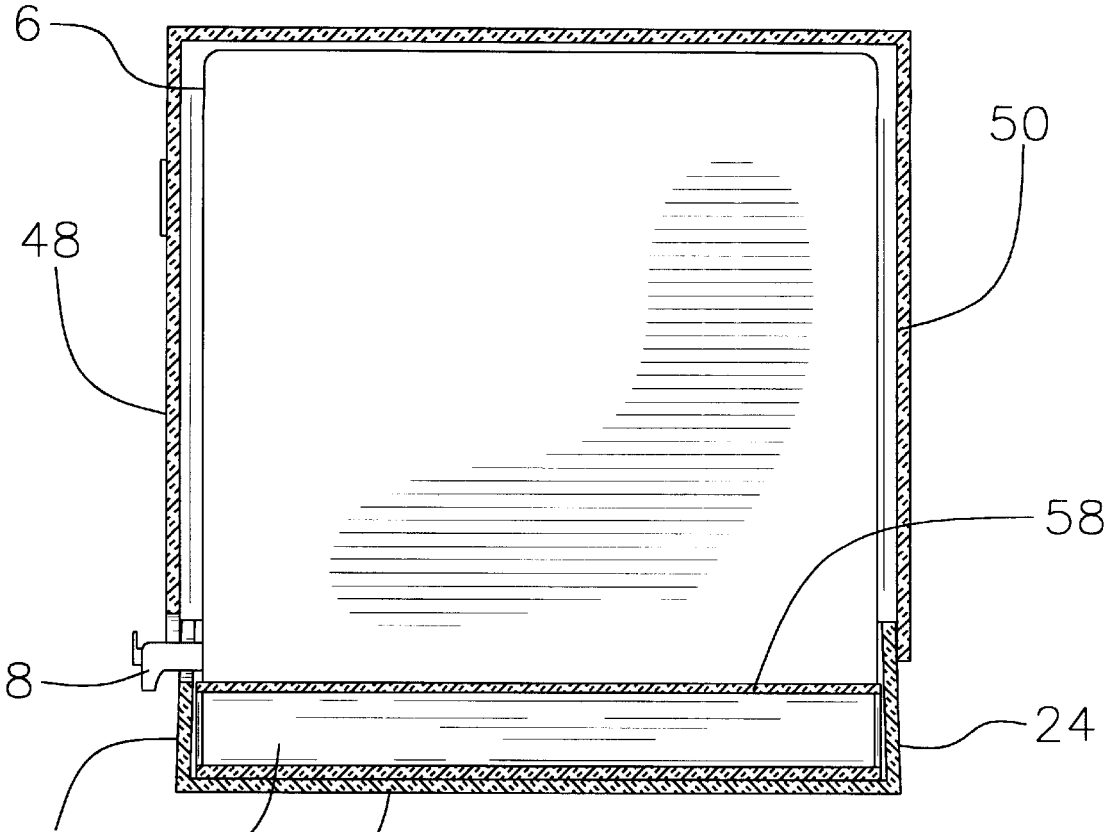
FIG. 4 is a schematic side cross-sectional view of the present invention.
Figure 5:
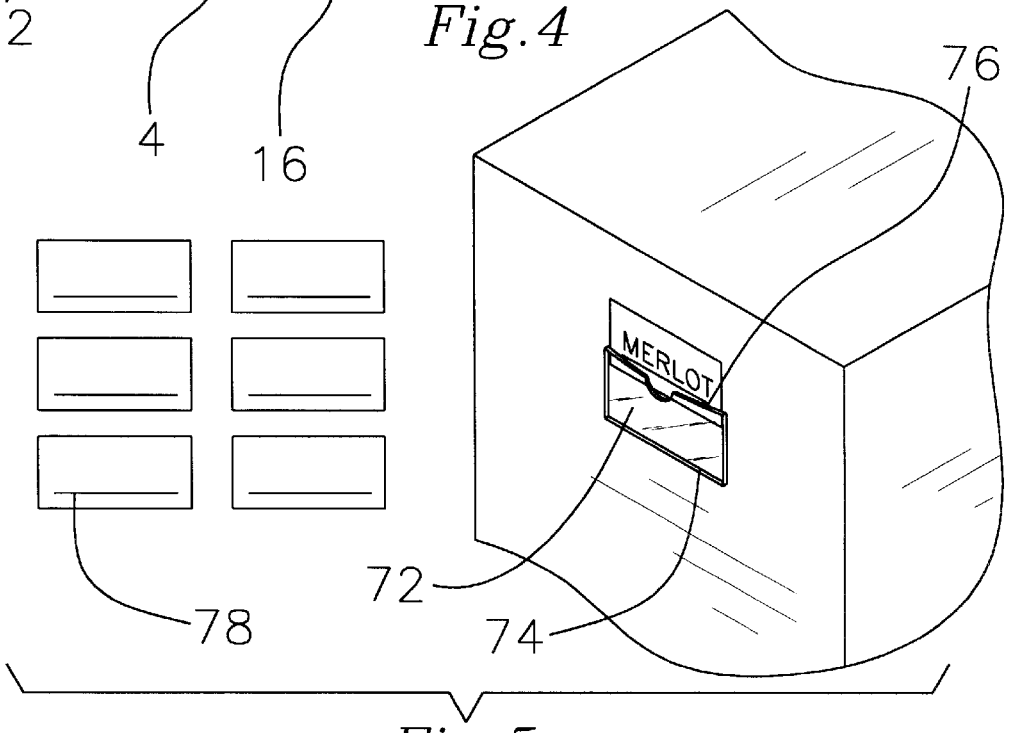
FIG. 5 is a schematic perspective exploded view of the labeling means of the present invention.

The cover portion 40 comprises a top wall 42. The top wall 42 has a peripheral edge 44. A perimeter wall 46 is integrally coupled to and extends downwardly from the peripheral edge 44 of the top wall 42 such that a proximal wall 48, a distal wall 50 and two side walls 52 are defined. An inner perimeter length of the perimeter wall 46 is substantially equal to an outer perimeter length of the peripheral wall 20 such that the cover portion 40 may be extended over the base portion 14 to define a closed position as depicted in FIG. 2. The proximal wall 48 has a bottom edge 54 having a slot 56 therein. The slot 56 is positioned to generally correspond with the depression 30. The perimeter wall 46 has a height generally greater than 3 times the height of the peripheral wall 20. The perimeter wall 46 ideally has a height generally between 12 and 16 inches. The slot and depression are preferably rounded.

A panel comprises 58 a flexible material. The flexible material comprising a conventional insulating material. The panel 58 ideally has a width greater than 3 times a width of the bottom wall 16 and a length substantially equal to a length of the bottom wall 16.

A carrying means 60 for carrying the device comprises a pair of rods 62. Each of the rods has a first end 64 and a second 66 end. Each of the rods 62 has an elongate channel 68 extending through the first 64 and second 66 ends. A continuous cord 70, such that it forms a loop, extends through the elongate channels 68 of the first and second rods. The rods 62 may be placed on opposite sides of the housing 12 and the cord 70 placed under the bottom portion 14 such that the rods 62 define handles for carrying the housing 12.

A labeling means labels the cover portion 40 so that the user knows what kind of wine is contained within. The labeling means includes a transparent panel 72. The transparent panel has four edges 74. Three of the edges are securely attached to an outside surface of the proximal wall 48 such that a fourth edge 76 allows access behind the transparent panel 72. The transparent panel 72 preferably comprises a plastic material. Each of a plurality of cards 78 has a shape adapted for is positioned between the proximal wall 48 and the transparent panel 72. The cards 78 may be written on and placed behind the transparent panel such that indicia on the card is visible.

In use, an ice block 4 is wrapped in the panel 58. The ice block 4 is positioned on the bottom wall 16 and a conventional wine box 6 is positioned on the ice block 4 such that the pour spout 8 coupled to the wine box 6 extends over the depression 30. The cover portion 40 is positioned over the base portion 14 and the wine box 6 is used in a conventional manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wine box cooling device for cooling and keeping cool a wine box, the wine box having a pouring spout built therein, the device being able to hold an ice block, said device comprising:

a housing comprising:

a base portion comprising a bottom wall having a peripheral edge, a peripheral wall being integrally coupled to and extending upwardly from said peripheral edge such that a front wall, a back wall and a pair of side walls are defined, said front wall having a top edge, said top edge of said front wall having a depression therein;

a cover portion comprising a top wall having a peripheral edge, a perimeter wall being integrally coupled to and extending downwardly from said peripheral edge of said top wall such that a proximal wall, a distal wall and two side walls are defined, said cover portion having a size adapted to cover said base portion;

said ice block being positioned within said base portion and said wine box being positioned on said ice block such that said pour spout extends over said depression;

a panel comprising a flexible and insulating material being wrapped about said ice block; and a carrying means for carrying said device comprising a pair of rods, each of said rods having a first end and a second end, each of said rods having an elongate channel extending through said first and second ends, a continuous cord extending through said elongate channels of said first and second rods, wherein said rods may be placed on opposite sides of said box and said cord placed under said bottom portion such that said rods define handles for carrying said device.

2. The wine box cooling device as in claim 1, wherein said housing further comprises:

an inner perimeter length of said perimeter wall of said cover portion being substantially equal to an outer perimeter length of said peripheral wall such that said cover portion may be extended over said base portion to define a closed position.

3. The wine box cooling device as in claim 1, wherein said housing further comprises:

said proximal wall of said cover portion having a bottom edge having a slot therein, said slot being positioned to generally correspond with said depression.

4. The wine box cooling device as in claim 1, wherein said housing further comprises:

said perimeter wall of said cover portion having a height generally greater than 3 times the height of said peripheral wall.

5. The wine box cooling device as in claim 1, wherein said housing further comprises:

said base and cover portions each comprising a plastic material.

6. The wine box cooling device as in claim 1, wherein said housing further comprises:

said perimeter wall of said cover portion having a height generally greater than 3 times the height of said peripheral wall.

7. The wine box cooling device as in claim 1, further comprising:

wherein said panel has a width greater than 3 times a width of said bottom wall and a length substantially equal to a length of said bottom wall.

8. The wine box cooling device as in claim 1, further comprising:

a labeling means for labeling said cover portion, said labeling means comprising:

a transparent panel for displaying the contents of said wine box, said transparent panel having four edges, three of said edges being securely attached to an outside surface of said proximal wall; and a plurality of cards for identifying the type of wine in the wine box contained within said housing, each of said cards having a shape adapted for being positioned between said proximal wall and said transparent panel.

9. A wine box cooling device for cooling and keeping cool a five liter wine box, the wine box having a pouring spout built therein, the device being able to hold an ice block, said device comprising:

a housing, said housing comprising:

a base portion, said base portion comprising a bottom wall, said bottom wall having a peripheral edge, a peripheral wall being integrally coupled to and extending upwardly from said peripheral edge such that a front wall, a back wall and a pair of side walls are defined, said front wall having a top edge, said top edge of said front wall forming a depression therein, said depression being positioned generally equidistant from said side walls, said peripheral wall having a height between 2 and 4 inches;

a cover portion, said cover portion comprising a top wall, said top wall having a peripheral edge, a perimeter wall being integrally coupled to and extending downwardly from said peripheral edge of said top wall such that a proximal wall, a distal wall and two side walls are defined, an inner perimeter length of said perimeter wall being substantially equal to an outer perimeter length of said peripheral wall such that said cover portion may be extended over said base portion to define a closed position, said proximal wall having a bottom edge having a slot therein, said slot being positioned to generally correspond with said depression, said perimeter wall having a height generally greater than 3 times the height of said peripheral wall, said perimeter wall having a height generally between 12 and 16 inches;

said base and cover portions each comprising a plastic material;

a panel, said panel comprising a flexible material, said flexible material comprising an insulating material, said panel having a width greater than 3 times a width of said bottom wall and a length substantially equal to a length of said bottom wall;

a carrying means for carrying said device, said carrying means comprising a pair of rods, each of said rods having a first end and a second end, each of said rods having an elongate channel extending through said first and second ends, a continuous cord extending through said elongate channels of said first and second rods, wherein said rods may be placed on opposite sides of said housing and said cord placed under said bottom portion such that said rods define handles for carrying said housing;

a labeling means for labeling said cover portion and identifying said wine box contained within said device comprising:

a transparent panel, said transparent panel having four edges, three of said edges being securely attached to an outside surface of said proximal wall;

a plurality of cards, each of said cards having a shape adapted for being positioned between said proximal wall and said transparent panel; and wherein the ice block is wrapped in said panel, wherein said ice block is positioned on said bottom wall and said wine box is positioned on said ice block such that said pour spout extends over said depression, wherein said cover portion is positioned over said base portion.

10. A wine box cooling device for cooling and keeping cool a wine box, said combination comprising:

a five liter wine box having a wine bladder contained within for releasably holding said wine, said wine bladder having a pouring spout built therein, said wine bladder being separable from said wine box;

an ice block for cooling and keeping cool said wine contained within said device;

a housing comprising:

a base portion comprising a bottom wall having a peripheral edge, a peripheral wall being integrally coupled to and extending upwardly from said peripheral edge such that a front wall, a back wall and a pair of side walls are defined, said front wall having a top edge, said top edge of said front wall forming a depression therein, said depression being positioned generally equidistant from said side walls, said peripheral wall having a height between 2 and 4 inches;

a cover portion comprising a top wall having a peripheral edge, a perimeter wall being integrally coupled to and extending downwardly from said peripheral edge of said top wall such that a proximal wall, a distal wall and two side walls are defined, an inner perimeter length of said perimeter wall being substantially equal to an outer perimeter length of said peripheral wall such that said cover portion may be extended over said base portion to define a closed position, said proximal wall having a bottom edge having a slot therein, said slot being positioned to generally correspond with said depression, said perimeter wall having a height generally greater than 3 times the height of said peripheral wall, said perimeter wall having a height generally between 12 and 16 inches;

said base and cover portions each comprising a plastic material;

a panel comprising a flexible material, said flexible material comprising an insulating material, said panel having a width greater than 3 times a width of said bottom wall and a length substantially equal to a length of said bottom wall;

a carrying means for carrying said device comprising a pair of rods, each of said rods having a first end and a second end, each of said rods having an elongate channel extending through said first and second ends, a continuous cord extending through said elongate channels of said first and second rods, wherein said rods may be placed on opposite sides of said housing and said cord placed under said bottom portion such that said rods define handles for carrying said housing;

a labeling means for labeling said cover portion comprising:

a transparent panel having four edges, three of said edges being securely attached to an outside surface of said proximal wall;

a plurality of cards, each of said cards having a shape adapted for being positioned between said proximal wall and said transparent panel; and wherein said ice block is wrapped in said panel and positioned on said bottom wall and said wine box is positioned on said ice block such that said pour spout extends over said depression, wherein said cover portion is positioned over said base portion.

* * * * *